US006377220B1

(12) United States Patent
Cook et al.

(10) Patent No.: US 6,377,220 B1
(45) Date of Patent: Apr. 23, 2002

(54) METHODS AND APPARATUS FOR MOUNTING AN ANTENNA SYSTEM TO A HEADLINER ASSEMBLY

(75) Inventors: Kristopher M. Cook, Lapeer; Lydia K. Gobis, South Lyon; Deyo D. Serrels, Lapeer; Richard A. Close, Farmington Hills, all of MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/459,278

(22) Filed: Dec. 13, 1999

(51) Int. Cl.[7] ..... H01Q 1/32

(52) U.S. Cl. ..... 343/713; 343/711; 439/34; 439/97

(58) Field of Search ..... 343/713, 711, 343/712, 906; 439/34, 95, 97, 98; H01Q 1/32

(56) References Cited

U.S. PATENT DOCUMENTS

| | | | | |
|---|---|---|---|---|
| 1,829,219 A | | 10/1931 | Heina | 343/711 |
| 1,973,301 A | | 9/1934 | Timian | 250/33 |
| 2,063,531 A | | 12/1936 | Tuttle | 250/33 |
| 2,094,168 A | | 9/1937 | Forbes | 250/33 |
| 2,520,988 A | | 9/1950 | Everitt | 250/33 |
| 4,707,700 A | | 11/1987 | Nagy | 343/712 |
| 4,721,963 A | | 1/1988 | Nagy et al. | 343/712 |
| 4,737,795 A | | 4/1988 | Nagy et al. | 343/712 |
| 4,758,166 A | | 7/1988 | Bonnett et al. | 343/712 |
| 4,769,655 A | | 9/1988 | Nagy et al. | 343/712 |
| 4,821,040 A | * | 4/1989 | Johnson et al. | 343/713 |
| 4,835,541 A | * | 5/1989 | Johnson et al. | 343/713 |
| 4,866,453 A | | 9/1989 | Nagy et al. | 343/712 |
| 5,049,892 A | | 9/1991 | Lindenmeier et al. | 343/713 |
| 5,309,634 A | * | 5/1994 | Van Order et al. | 29/863 |
| 5,402,130 A | | 3/1995 | Miller et al. | 343/742 |
| 5,492,260 A | * | 2/1996 | Rieden et al. | 224/553 |
| 5,532,709 A | | 7/1996 | Talty | 343/819 |

* cited by examiner

*Primary Examiner*—Hoanganh Le
(74) *Attorney, Agent, or Firm*—Laura C. Hargitt

(57) ABSTRACT

An antenna system for a vehicle includes a fastener assembly, antenna modules, a headliner and co-axial cables. The fastener assembly includes a fastener which secures the headliner and antenna system to the vehicle, a grounding strap which grounds the antenna system, and a coat hook. The antenna system, including the antenna modules and the co-axial cables, is mounted to the headliner. The fastener assembly simultaneously secures the headliner to the vehicle and grounds the antenna system.

15 Claims, 7 Drawing Sheets

METHODS AND APPARATUS FOR MOUNTING AN ANTENNA SYSTEM TO A HEADLINER ASSEMBLY

BACKGROUND OF THE INVENTION

This invention relates generally to mounting systems and, more particularly, to mounting systems for mounting an antenna system to a vehicle.

Typical hidden antenna systems are labor intensive to install and include modules, wires, and coaxial cables mounted directly to sheet metal with a plurality of metal clips. The metal clips may vibrate against the sheet metal and loosen over time.

Because the antenna systems are installed directly to the sheet metal above a vehicle headliner, extensive disassembly of the vehicle is necessary to perform any maintenance on the antenna system or to replace the metal clips. The headliner and all of the headliner fastener components are first removed to access the sheet metal. Often the headliners are constructed of one piece which is too large to remove from the vehicle. As a result, performing any maintenance on the overhead antenna system may be a tedious and laborious task.

BRIEF SUMMARY OF THE INVENTION

In an exemplary embodiment, an antenna system for a vehicle includes a fastener assembly which reduces assembly labor costs and improves the antenna system performance. The antenna system includes a headliner, a plurality of antenna modules and coaxial cables mounted to the headliner, and a fastener assembly which attaches the headliner to the vehicle. The fastener assembly includes a fastener which simultaneously secures and grounds the antenna system and a coat hook. The antenna system components are secured to a headliner rather than directly to sheet-metal. As a result, the number of assembly parts is reduced. In addition, the headliner is non-metallic and provides a damping effect to eliminate squeaks, rattles, and vibrations between the antenna system and the sheet-metal. Accordingly, labor costs are lowered because less time is expended attaching the system to the headliner rather than securing components overhead to the vehicle sheet-metal. Additionally, antenna system performance is improved because module lead lengths are optimized and a low impedance radio frequency (RF) ground is maintained between the antenna system and the vehicle.

DETAILED DESCRIPTION OF THE INVENTION

Figure 1:
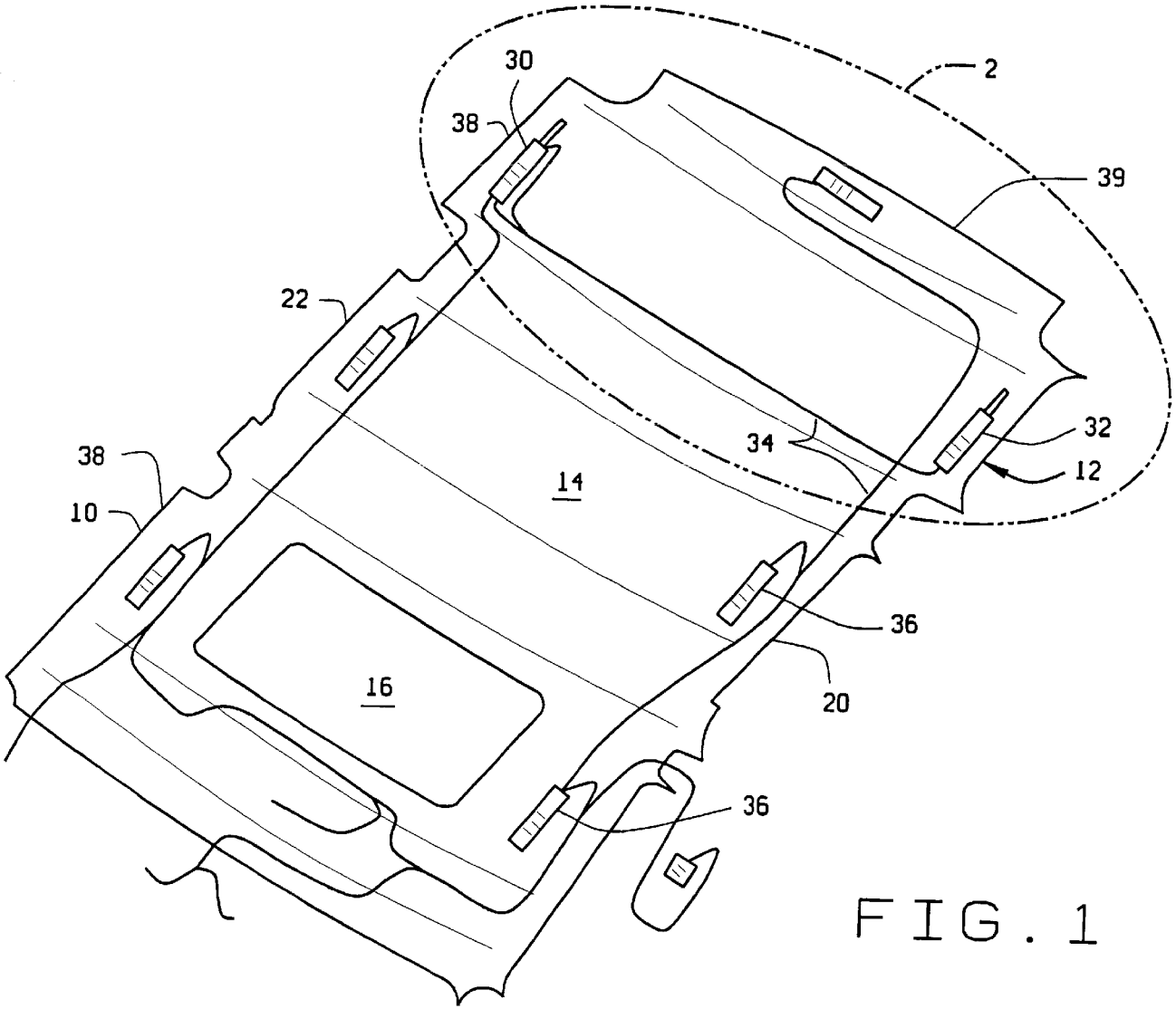
FIG. 1 is a perspective view of a top side of a headliner including an installed antenna system.

FIG. 1 is a perspective view of a headliner 10 including an installed antenna system 12. Headliner 10 is generally rectangular in shape and is installed in a vehicle (not shown) such that a top surface 14 of headliner 10 is adjacent a bottom side (not shown) of a roof assembly (not shown in FIG. 1) of a vehicle body. A bottom surface (not shown) of headliner 10 provides a decorative interior covering (not shown) for an interior (not shown) of the vehicle. Headliner 10 is of unitary construction and fabricated to conform to the bottom side of the roof assembly. Alternatively, headliner 10 may have a multi-piece construction. Additionally, headliner 10 is fabricated from various materials which provide damping as compared to bare sheet metal, including polyurethane, fiberglass, polyester, or reinforced cardboard. An opening 16 is disposed in headliner 10 for access to a vehicle sunroof (not shown). Headliner 10 has a driver edge 20 and a passenger edge 22.

Antenna system 12 includes a first antenna module 30 attached to headliner 10 adjacent driver edge 20 and a second antenna module 32 attached to headliner 10 adjacent passenger edge 22. A plurality of coaxial cables 34 are attached to headliner 10 and are electrically connected to various electrical components of antenna system 12 including first antenna module 30, second antenna module 32, and a radio (not shown). A plurality of receptacles 36 are also attached to headliner 10 adjacent driver edge 20, passenger edge 22, and along a rear window edge 37. Receptacles 36 hold a plurality of lighting assemblies (not shown) which mount to receptacles 36 from the bottom surface of headliner 10. In one embodiment, receptacles 36 are centered above each of a plurality of side window openings 38 on first side 20 and second side 22 and are centered above a rear window opening 39 on back side 18.

Figure 2:
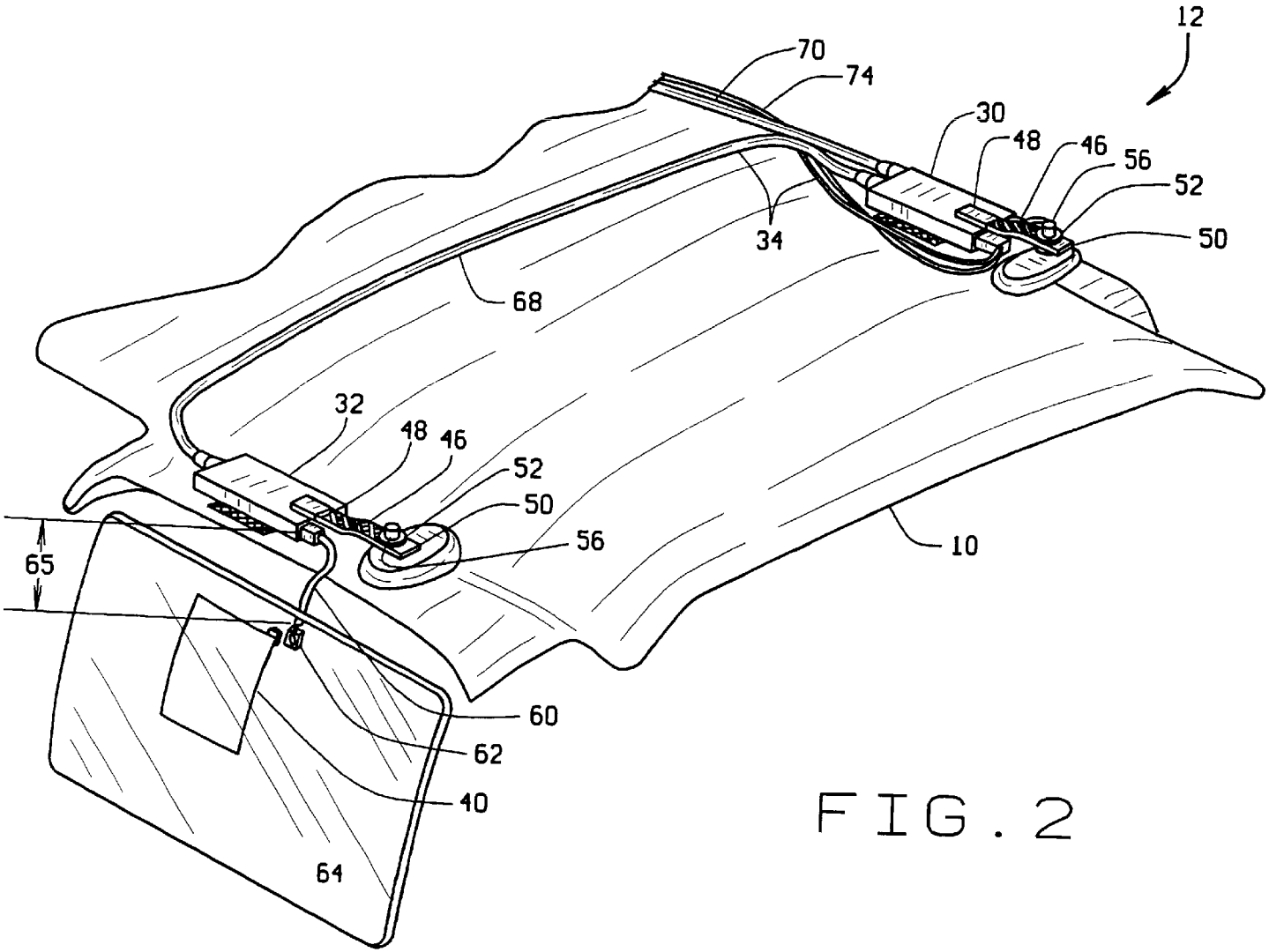
FIG. 2 is an enlarged perspective view of a portion of the headliner and installed antenna system shown in FIG. 1 in area 2.

FIG. 2 is an enlarged perspective view in area 2 of FIG. 1 showing headliner 10 including antenna system 12. Antenna system 12 includes first antenna module 30 and second antenna module 32. In one embodiment, first antenna module 30 is a diversity antenna module which supplies power to second antenna module 32 and which combines radio frequency (RF) energy received from a left frequency modulation (FM) antenna element 40 and a right amplitude modulation (AM) antenna element (not shown), and transmits the energy to the radio. In another embodiment, second antenna module 32 is an impedance matching module which receives RF energy and matches an antenna system antenna impedance to 50 Ohms.

First antenna module 30 and second antenna module 32 are both fixedly attached to headliner 10. In one embodiment, first antenna module 30 and second antenna module 32 are glued to headliner 10. In another embodiment, first antenna module 30 and second antenna module 32 are attached to headliner 10 with hook and loop fasteners which improves serviceability. Alternatively, first antenna module 30 and second antenna module 32 are attached to headliner 10 with adhesive tape. Mounting antenna module 30 and 32 to headliner 10 facilitates eliminating squeaks and rattles.

A grounding strap 46 is attached to first antenna module 30 and second antenna module 32. In one embodiment, grounding straps 46 are welded to antenna modules 30 and 32. Grounding straps 46 are flexible and provide case grounding capability between antenna modules 30 and 32 and the vehicle body. Antenna system 12 requires a low impedance RF robust ground with respect to metal, which provides a ground plane reference for left FM antenna element 40 and the right FM antenna element. Grounding straps 46 provide antenna system 12 with the low impedance RF robust ground with respect to metal. Alternatively, antenna system 12 includes antenna modules 30 and 32 which are not grounded integrally with antenna system 12.

Grounding straps 46 have a first end 48 and a second end 50. First end 48 is attached to antenna modules 30 and 32 and second end 50 includes a grounding strap ring terminal 52. Grounding straps 46 extend from antenna modules 30 and 32 to grounding strap ring terminals 52. Grounding strap ring terminals 52 are annular in shape and include an opening (not shown). The grounding strap ring terminal openings are positioned concentrically with openings (not shown) disposed in grounding straps 46. The grounding strap ring terminal openings and the grounding strap openings are sized to receive a fastener 56. Additionally, grounding strap ring terminals 52 are sized to receive fastener 56 which is a grounding bolt which connects grounding strap 46 to a weld nut (not shown in FIG. 2) attached to the vehicle body.

An antenna lead 60 extends from antenna module 32 to an antenna terminal 62. Antenna lead 60 carries RF energy to antenna module 32 and antenna terminal 62 provides a connection between antenna lead 60 and left FM antenna element 40. Antenna element 40 receives entertainment band RF energy and is mounted to a left hand side window glass 64. Antenna lead 60 has a length 65 which extends from antenna module 32 to antenna terminal 62. Length 65 is short in comparison to known antenna system antenna leads, and accordingly antenna module 32 is positioned closer to antenna 40 than known antenna systems to reduce an input impedance of interface and optimize the performance of antenna 40. A separate antenna lead (not shown) is constructed similarly to antenna module 30 and extends to the right FM antenna element.

Coaxial cables 34 are attached to headliner 10. In one embodiment, coaxial cables 34 are glued to headliner 10. Alternatively, coaxial cables 34 are attached with an adhesive tape, clips, or a hook and loop assembly. Coaxial cables 34 include a cross-car coaxial cable 68 and a fore/aft coaxial cable 70. Cross-car coaxial cable 68 connects antenna module 30 to antenna module 32 and directs RF energy from antenna module 32 to antenna module 30. Cross-car coaxial cable 68 includes a center conductor (not shown) which provides power from antenna module 30 to antenna module 32. In an alternative embodiment, the center conductor is a separate wire which extends from cross-car coaxial cable 68. Fore/aft coaxial cable 70 extends from antenna module 30 and electrically connects antenna module 30 to the vehicle radio. Fore/aft coaxial cable 70 also carries antenna system power supplied from the radio utilizing a switched power out pin (not shown). Antenna system 12 includes a reduced number of coaxial cables 34 in comparison to known systems. Accordingly, the number of electrical connections between coaxial cables 34 and components (e.g. 30, 32) is reduced which reduces the signal loss for antenna system 12 and improves the overall performance of antenna system 12.

A signal wire 74 also extends from antenna module 30 to the radio. Signal wire 74 is attached to headliner 10 (shown in FIG. 1) in the same manner as coaxial cables 34. Quality information is transmitted to antenna module 30 through signal wire 74 which provides a feedback loop for adjusting a signal transmitted to the radio when the radio is operating.

Figure 3:
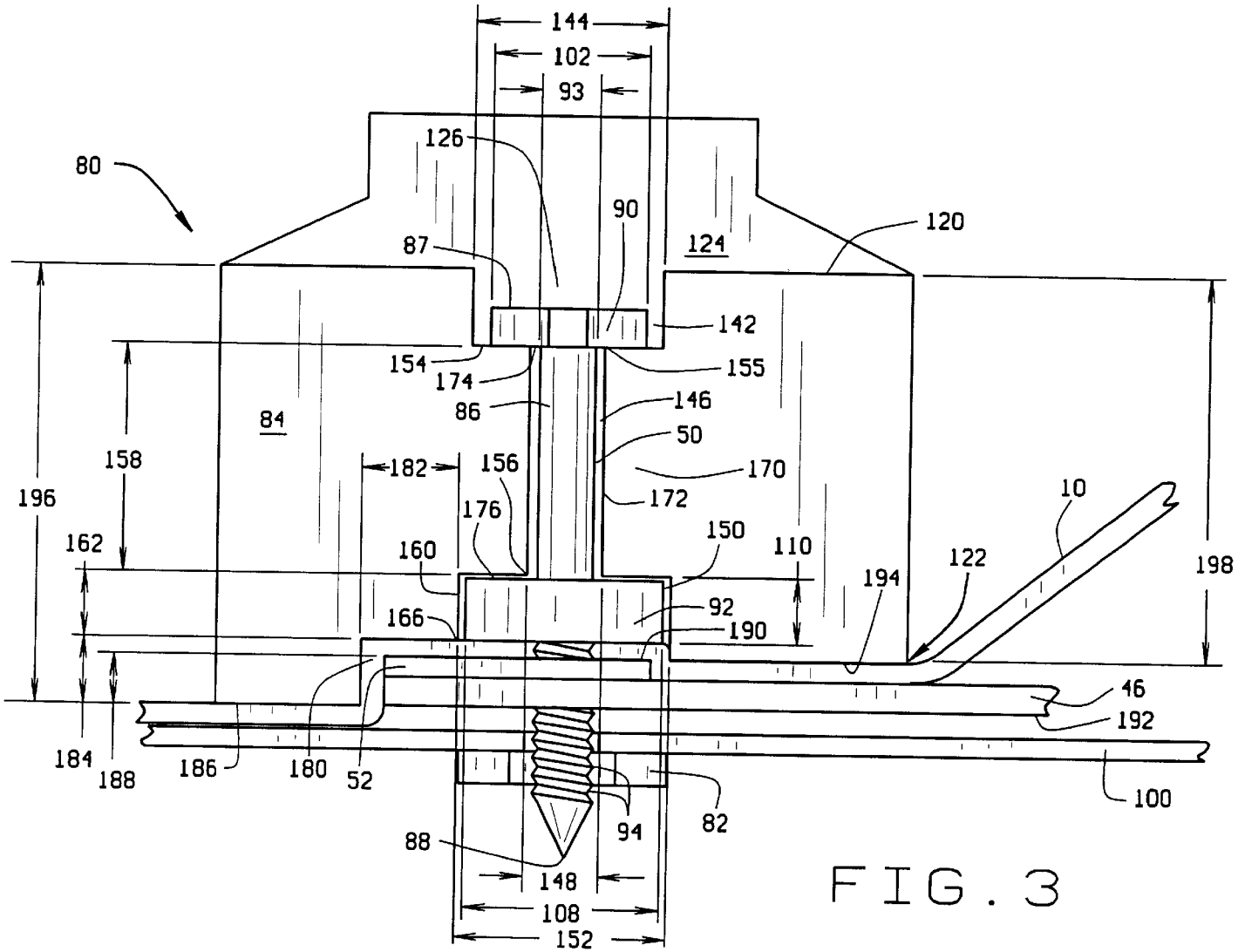
FIG. 3 is a side schematic view of a fastener assembly used to secure the headliner shown in FIG. 1.
Figure 4:
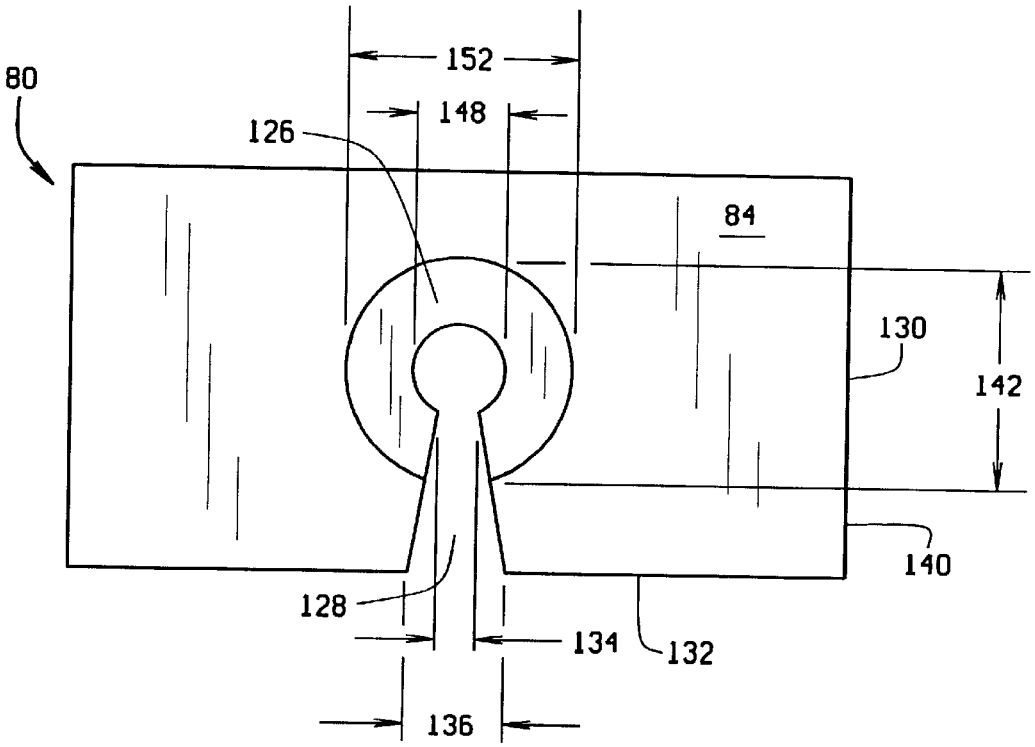
FIG. 4 is a bottom view of the fastener assembly shown in FIG. 3.
Figure 5:
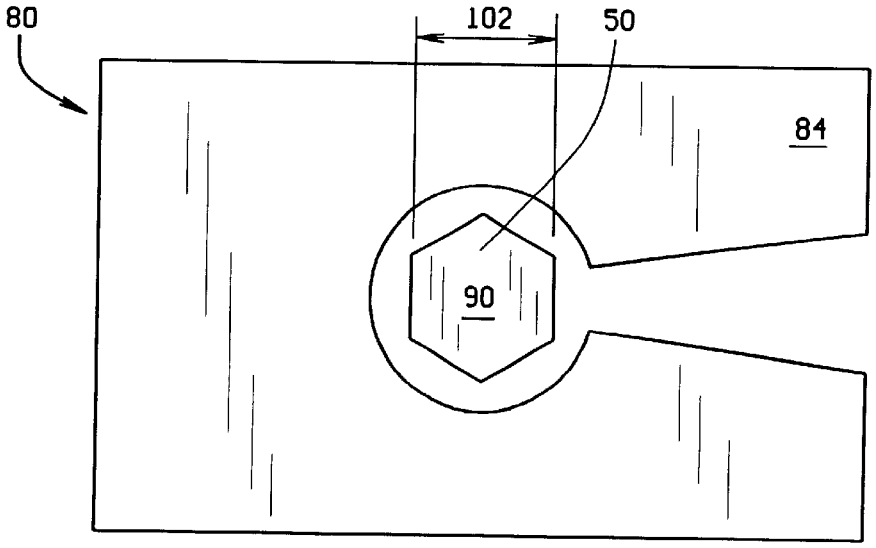
FIG. 5 is a top view of the fastener assembly shown in FIG. 3.

FIGS. 3, 4, and 5 are a side schematic view of a fastener assembly 80 used in installing antenna system 12 (shown in FIG. 2), a bottom view of fastener assembly 80, and a top view of fastener assembly 80. Fastener assembly 80 includes fastener 50, a weld nut 82, and a coat hook 84. Fastener 50 includes a shank 86 positioned between a fastener first end 87 and a fastener second end 88, a fastener head 90, and a radial projection 92. Shank 86 has a diameter 93 and a plurality of threads 94 located on diameter 93 between radial projection 92 and second end 88. Threads 94 are sized to be received in weld nut 82 which is attached to a vehicle body inner roof 100.

Fastener head 90 has an outer diameter 102 which is larger than diameter 93 of shank 86. Fastener head outer diameter 102 is hexagonal shaped and is configured to be received in a wrench (not shown). Fastener head 90 is configured to be rotated by the wrench which causes a simultaneous rotation of shank 86.

Radial projection 92 extends from shank 86 and has a diameter 108 and a thickness 110. Diameter 108 is larger than diameter 93 of shank 86. Radial projection 92 is located between second end 88 of shank 86 and fastener head 90.

Coat hook 84 includes a top surface 120, a bottom surface 122, an exterior surface 124, and a center opening 126. Exterior surface 124 provides a decorative interior surface for an interior (not shown) of the vehicle.

Coat hook 84 includes a first slot 128 and a second slot 130. First slot 128 extends from a first side 132 towards center opening 126. First slot 128 is tapered and has an outer width 134 which is wider than an inner width 136. Inner width 136 is slightly smaller than shank diameter 93. First slot 128 is configured to receive fastener 50. Coat hook 84 is fabricated from a flexible material (not shown) which permits first slot 128 to expand apart to permit coat hook 84 to flex at inner width 136 to receive fastener 86 in a snap fit which prevents fastener 50 from falling out of coat hook 84 as headliner 10 is inverted and attached to vehicle body inner roof 100. Alternatively, coat hook 84 includes a metal retainer (not shown in FIGS. 3, 4 or 5) which retains coat hook 84 to headliner 10 to prevent fastener 50 from falling out of coat hook 84 as headliner 10 is inverted.

Second slot 130 extends from a second side 140 towards center opening 126. Second slot 130 is configured to receive grounding strap 46 and has a width 142 which remains constant from coat hook second side 140 to center opening 126. In one embodiment, second slot 130 is disposed approximately ninety degrees from slot 128.

Center opening 126 includes a first recess 142 which has a first diameter 144, a second recess 146 which has a second diameter 148, and a third recess 150 which has a third diameter 152. First recess 142 extends from top surface 120 inward towards bottom surface 122 to a wall 154. Wall 154 extends from diameter 144 towards center opening 126 to a shoulder 155. First recess 142 is sized to receive fastener head 90 and first diameter 144 is sized larger than fastener head diameter 102 such that a socket (not shown) can be installed over fastener head 90 and rotate fastener head 90 without contacting coat hook first recess 142. First recess 142 borders second recess 146 which is disposed between first recess 142 and third recess 150.

Second recess diameter 148 extends from shoulder 155 to a shoulder 156 for a length 158. Diameter 148 is smaller than fastener head diameter 102 and is slightly larger than shank diameter 93. Second recess diameter 148 remains constant from shoulder 155 to shoulder 156 along length 158.

Third recess 150 is sized to receive radial projection 92 of fastener 50 and extends outward from shoulder 156 to a wall 160 positioned at third diameter 152. Third diameter 152 is larger than radial projection diameter 108. Wall 160 has a width 162 which extends from shoulder 156 to a shoulder 166. Width 162 is approximately equal to radial projection thickness 110.

Coat hook 84 includes a radial projection 170 disposed between shoulder 155 and shoulder 156. Radial projection 170 includes a wall 172 having width 158 which defines second recess 146 and engages an installed fastener 50 between a bottom surface 174 of fastener head 90 and a top surface 176 of radial projection 92.

A fourth recess 180 extends outward from shoulder 166 away from center opening 126 for a distance 182. Fourth recess 170 borders third recess 150 and is semi-circular shaped and configured to receive grounding strap ring terminal 52 attached to grounding strap 46. Fourth recess 170 has a width 184 which extends from shoulder 166 to a first half 186 of coat hook bottom surface 122. Width 184 is approximately equal to a width 188 which extends from a top surface 190 of grounding strap ring terminal 52 to a bottom surface 192 of an attached grounding strap 46.

Bottom surface 122 includes first half 186 and a second half 194. First half 186 is substantially flat and is located a distance 196 from coat hook top surface 120. Second half 194 is substantially flat and is located a distance 198 from coat hook top surface 120. Distance 196 is greater than distance 198 which permits coat hook second half 194 and first half 186 to anchor flush against headliner 10 when coat hook 84 is fully installed to vehicle body inner roof 100.

Fastener assembly 80 is fastened to vehicle body inner roof 100 with fastener 50. Fastener 50 is initially inserted within coat hook slot 128 and is snap fit into center opening 126 which causes coat hook radial projection 170 to engage fastener shank 86. When coat hook radial projection 170 engages fastener shank 86, fastener 50 is prevented from falling out of coat hook 84 when headliner 10 is inverted to be attached to vehicle body inner roof 100. Coat hook 84 is then positioned adjacent headliner 10 and fastener 50 is inserted through headliner 10 and through grounding strap ring terminal 52. Coat hook 84 is rotated to position slot 130 above grounding strap 46. Fastener assembly 80 and headliner 10 are then inverted and positioned adjacent vehicle body inner roof 100. Fastener 50 is rotated and tightened into weld nut 82 and coat hook 84 is drawn snugly against headliner 10 and against vehicle body inner roof 100. Fastener radial projection 92 is simultaneously drawn tightly against grounding strap ring terminal 52. As fastener 50 is rotated, a lower surface 200 of fastener radial projection 92 contacts top surface 190 of grounding strap ring terminal 52 and using a wiping action, cleans top surface 190 to provide a reliable grounding between fastener 50 and grounding strap ring terminal 52. Accordingly, fastener 50 simultaneously secures coat hook 84 to vehicle body inner roof 100 and grounds antenna system 12.

Figure 6:
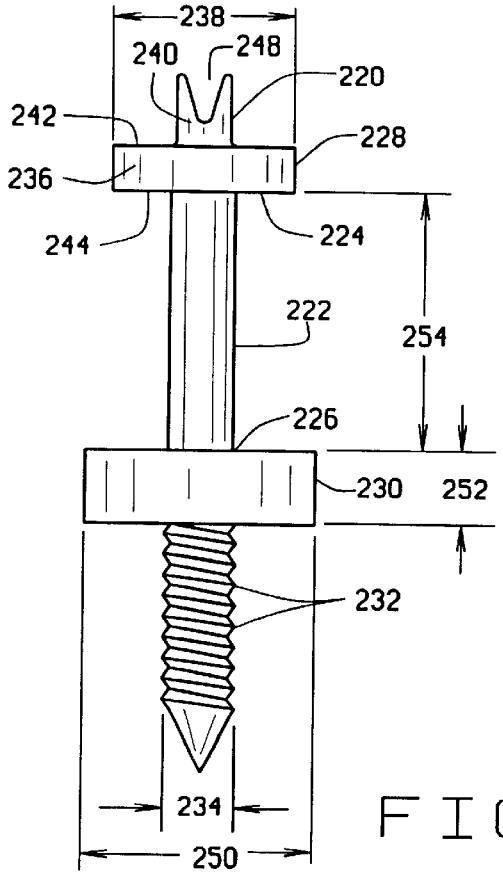
FIG. 6 is a side view of an alternative embodiment of a fastener.

FIG. 6 is a side view of an alternative embodiment of a fastener 220 configured to be received in fastener assembly 80 (shown in FIG. 3) when installing headliner 10 (shown in FIG. 1) to vehicle body inner roof 100 (shown in FIG. 3). Fastener 220 includes a shank 222 which has a first end 224 and a second end 226, a fastener head 228, and a radial projection 230. A plurality of threads 232 are disposed on shank 222 which has a diameter 234. Threads 232 are sized to be received in weld nut 82 (shown in FIG. 3). Fastener head 228 has a lower body portion 236 which has an outer diameter 238 and an upper body portion 240 which extends away from lower body portion 236. Lower body portion 236 includes an upper surface 242 and a lower surface 244. Lower body portion diameter 238 is circular and is larger than diameter 234 of fastener shank 222.

Upper body portion 240 extends from lower body portion upper surface 242 and is cylindrical in shape. Upper body portion 240 includes an upper surface 246 which has a slot 248 disposed within it. Slot 248 extends inward from upper surface 246 towards lower body portion 236 and is sized to receive a screwdriver tip (not shown). Fastener head 228 is configured to be rotated by the screwdriver tip which rotates shank 222 simultaneously as fastener head 228 is rotated.

Radial projection 230 extends from fastener shank 222 and has a diameter 250 and a thickness 252. Diameter 250 is larger than diameter 234 of shank 222. Radial projection 230 is a distance 254 from fastener head lower body portion lower surface 244. Distance 254 is approximately equal to width 173 of coat hook radial projection 170. Accordingly, coat hook radial projection 170 engages fastener shank 222 when fastener 220 is installed in fastener assembly 80.

Figure 7:
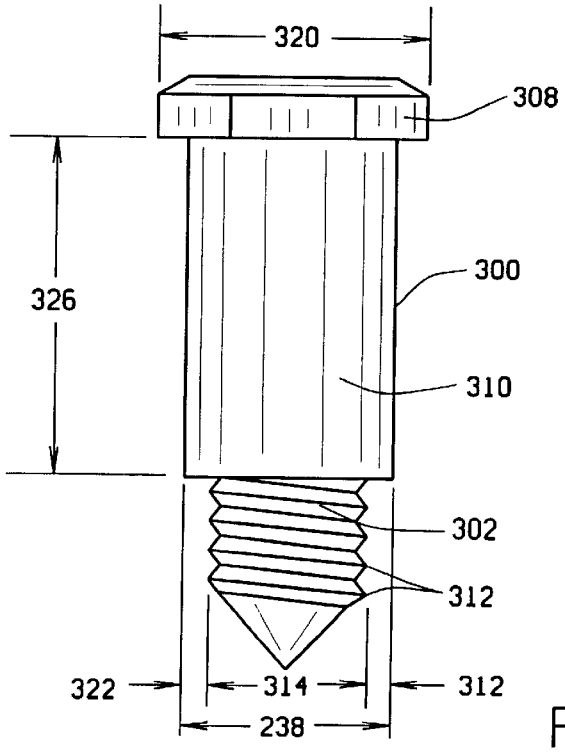
FIG. 7 is a side view of another alternative embodiment of a fastener.
Figure 8:
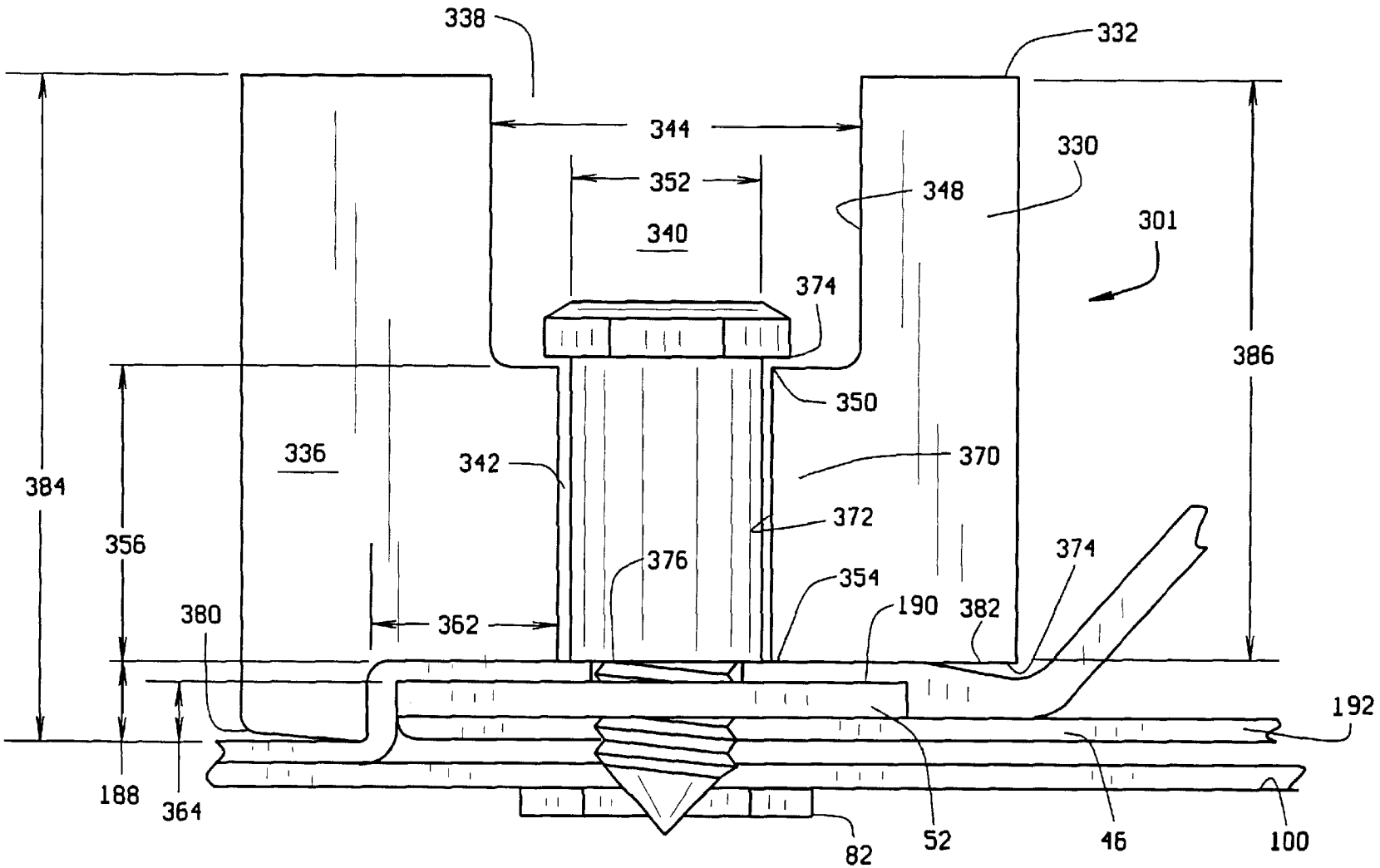
FIG. 8 is a side view of another alternative embodiment of a fastener assembly.

FIGS. 7 and 8 are a side view of an alternative embodiment of a fastener 300 and an alternative fastener assembly 301 for use with fastener 300 in installing headliner 10 to vehicle body inner roof 100. Fastener 300 includes a shank 302, a fastener head 308, and a radial projection 310. A plurality of threads 312 are disposed on shank 302 which has a diameter 314. Threads 312 are sized to be received in weld nut 82 attached to vehicle body inner roof 100.

Fastener head 308 has an outer diameter 320 which is larger than diameter 314 of shank 302. Fastener head outer diameter 320 is hexagonal-shaped and is configured to be received in and rotated by a wrench (not shown). In an alternative embodiment, fastener head 320 is fabricated similar to fastener head 228 (shown in FIG. 6) and is configured to be rotated by a screwdriver tip. Fastener head 308 is configured to be rotated by the wrench. Shank 302 is rotated simultaneously with fastener head 308.

Radial projection 310 extends outward from shank 302 and has a diameter 322 which is larger than diameter 314 of shank 302. Radial projection 310 extends from fastener head 308 towards fastener shank 302.

Fastener assembly 301 includes fastener 300 and a coat hook 330. Coat hook 330 includes a top surface 332, a bottom surface 334, an exterior surface 336, and a center opening 338 which extends from top surface 332 to bottom surface 334. Exterior surface 336 provides a decorative interior surface for an interior (not shown) of a vehicle (not shown) when fastener assembly 301 is fully installed.

Coat hook center opening 338 has a first recess 340 and a second recess 342 which extends from first recess 340. First recess 340 has a diameter 344 which is larger than diameter 320 of fastener head 308. Diameter 344 Is sized to receive fastener head 308 such that a socket (not shown) can be installed over fastener head 308 and be rotated without striking first recess 340.

Center opening first recess 340 includes a wall 348 located at first recess diameter 344 which curves and extends to a shoulder 350. Second recess 342 has a diameter 352 which extends from shoulder 350 to a shoulder 354 for a length 356. Diameter 352 is smaller than fastener head diameter 320 and is slightly larger than fastener shank diameter 314. Second recess diameter 352 remains constant from shoulder 350 to shoulder 354 along length 356. Length 356 is approximately equal to fastener radial projection distance 326.

Coat hook 330 includes a third recess 360 which extends outward from second recess diameter 353 at shoulder 354 for a distance 362. Third recess 360 is semi-circular shaped and is configured to receive grounding strap ring terminal 52 attached to grounding strap 46. Third recess 360 has a width 364 which extends from shoulder 354 to a first bottom surface 368 of coat hook 330. Width 364 is approximately equal to width 188 which extends from top surface 190 of grounding strap ring terminal 52 to bottom surface 192 of grounding strap 46 which grounding strap ring terminal 52 is attached.

Coat hook 330 includes a radial projection 370 disposed between shoulder 350 and shoulder 354. Radial projection 370 includes a wall 372 having a width 356 which defines second recess 342 and engages fastener 300 between a bottom surface 374 of fastener head 301 and a bottom edge 376 of radial projection 370.

Coat hook bottom surface 334 includes a first half 380 and a second half 382. First half 380 is substantially flat and is located a distance 384 from coat hook top surface 332. Second half 382 is substantially flat and is located a distance 386 from coat hook top surface 332. Distance 384 is greater than distance 386 which permits coat hook second half 382 and first half 380 to anchor flush against headliner 10 when coat hook 330 is fully installed to vehicle body inner roof 100.

Figure 9:
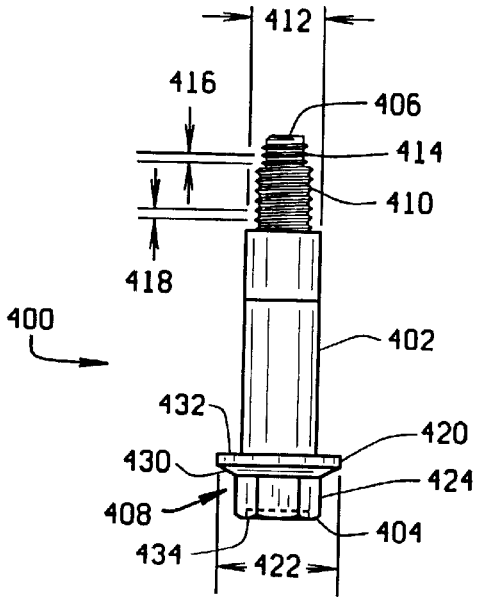
FIG. 9 is a side view of a further alternative embodiment of a fastener.
Figure 10:
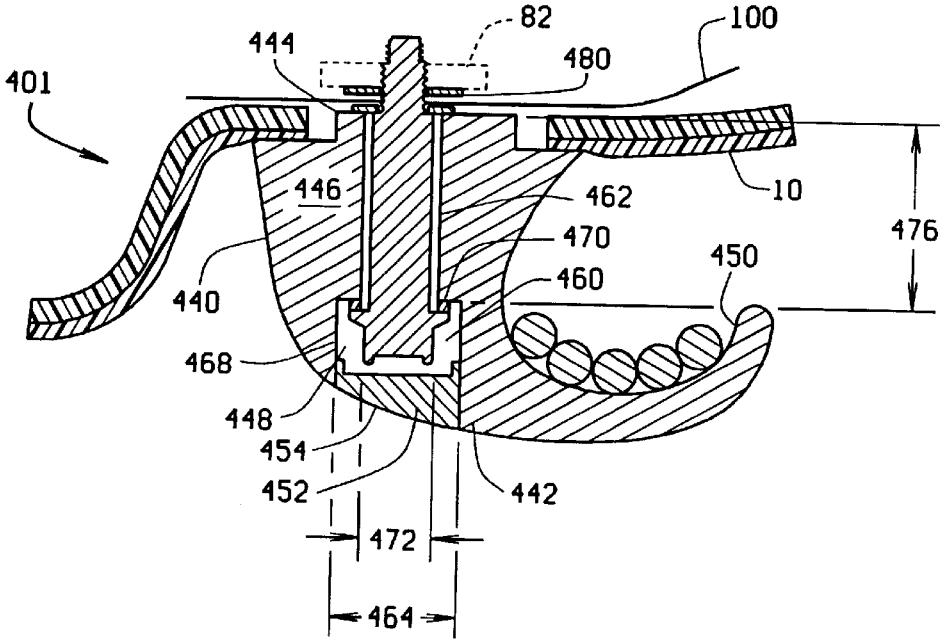
FIG. 10 is a side view of a further alternative embodiment of a fastener assembly including the fastener shown in FIG. 9.

FIGS. 9 and 10 are a side view of a further alternative embodiment of a fastener 400 and an alternative fastener assembly 401 for use with fastener 400 in installing headliner 10 to vehicle body inner roof 100. Fastener 400 includes a shank 402 which has a first end 404 and a second end 406, and a fastener head 408. A first plurality of threads 410 are disposed on shank 402 which has a diameter 412. Threads 410 are sized to be received in weld nut 82 (shown in FIG. 3). A second plurality of threads 414 are disposed on shank 402 between threads 410 and fastener second end 406. Threads 414 are starter threads which have a wider clearance 416 between adjacent threads 414 than a clearance 418 of threads 410. Wider clearance 416 permits the user to easily thread fastener 400 through fastener assembly 401 and into weld nut 82. After threads 414 are rotated into weld nut 82, threads 410 secure headliner 10 to vehicle body inner roof 100.

Fastener head 408 has a lower body portion 420 which has an outer diameter 422 and an upper body portion 424 which extends away from lower body portion 420. Lower body portion 420 includes an upper surface 430 and a lower surface 432. Lower body portion diameter 422 is circular and is larger than diameter 412 of fastener shank 402.

Upper body portion 424 extends from lower body portion upper surface 430 and is hexagonal in shape. Upper body portion 424 includes an upper surface 434 which has is sized to receive the wrench or a socket head (not shown). Fastener head 408 is configured to be rotated by the wrench or with a socket driver (not shown) which rotates shank 402 simultaneously as fastener head 408 is rotated.

Fastener assembly 401 includes fastener 400 and a coat hook 440. Coat hook 440 includes a top surface 442, a bottom portion 444, an exterior surface 446, and a center opening 448 which extends from top surface 442 through bottom portion 444 to exterior surface 446. Exterior surface 446 provides a decorative interior surface for an interior (not shown) of a vehicle (not shown) when fastener assembly 401 is fully installed. Bottom portion 444 includes a curved surface 450 for receiving coat hangers (not shown) when fastener assembly 401 is installed in the vehicle. Bottom portion 444 also includes a plug 452 which in installed within center opening 448 such that an exterior surface 454 of plug 452 is co-planar with exterior surface 446 of fastener assembly 401. Plug 452 is installed after fastener assembly 401 is fully installed and covers center opening 448 to provides a decorative interior surface for the interior of the vehicle.

Coat hook center opening 448 has a first recess 460 and a second recess 462 which extends from first recess 460. First recess 460 has a diameter 464 which is larger than diameter 422 of fastener head 408. Diameter 464 is sized to receive fastener head 408 such that the socket can be installed over fastener head 408 and be rotated without striking first recess 460.

Center opening first recess 460 includes a wall 468 located at first recess diameter 464 which extends to form a shoulder 470. Second recess 464 has a diameter 472 which extends from shoulder 470 to a coat hook top surface 442 for a length 476. Diameter 472 is smaller than fastener head diameter 422 and is slightly larger than fastener shank diameter 412.

Fastener assembly 401 includes a metal retainer 480 which retains fastener 400 against headliner 10 when headliner 10 is inverted and installed within the vehicle. Metal retainer 480 is sized to receive first plurality of threads 410 and contacts second plurality of threads 414 to retain fastener assembly 401 against headliner 10.

The above described antenna system is reliable, easily installed, and cost-effective. The antenna system is mounted to the headliner and includes no clips which must be mounted overhead to the vehicle body inner roof Additionally, the antenna system includes a fastener assembly which simultaneously secures the headliner assembly to the vehicle and provides a robust ground for the antenna system. A cost-effective and reliable antenna system is provided.

While the invention has been described in terms of various specific embodiments, those skilled in the art will recognize that the invention can be practiced with modification within the spirit and scope of the claims.

What is claimed is:

1. An antenna system for a vehicle, said antenna system comprising:

a headliner;

an antenna module attached to said headliner;

at least one grounding strap attached to said antenna module;

an impedance matching module electrically connected to said antenna module;

a plurality of coaxial cables attached to said headliner, a first of said plurality of coaxial cables electrically connected between said impedance matching module and said antenna module;

an antenna electrically connected to said antenna module;

a power cable attached to said headliner, said power cable electrically connected to said antenna system; and a plurality of coat hooks and a plurality of fasteners, at least one of said plurality of coat hooks configured to engage said at least one of said plurality of fasteners, at least one of said plurality of fasteners configured to attach said grounding strap to the vehicle.

2. The antenna system in accordance with claim 1 wherein said fastener comprises a shank, at least one radial projection configured to engage said grounding strap and extending from said shank, and a fastener head extending from said shank and configured to rotate said shank.

3. The antenna system in accordance with claim 2 wherein said shank comprises a first diameter, said fastener head comprises a second diameter, said fastener head second diameter greater than said shank first diameter, said fastener head further configured to engage said coat hook.

4. The antenna system in accordance with claim 3 wherein said radial projection comprises a third diameter greater than said shank diameter.

5. A fastener comprising:

a shank comprising a first end, a second end, and an outer diameter, said second end for securing said fastener to a vehicle headliner such that at least one electrical module is electrically grounded by said fastener;

a fastener head extending from said shank first end and configured to rotate said shank; and at least on e radial projection extending from said shank outer diameter, said radial projection located between said head and said second end of said shank.

6. The fastener in accordance with claim 5 wherein said shank second end comprises threads configured to be received in the vehicle.

7. The fastener in accordance with claim 6 wherein said threads extend along said shank outer diameter from said radial projection to said shank second end.

8. The fastener in accordance with claim 6 wherein said radial projection for engaging a ground lug.

9. The fastener in accordance with claim 8 wherein said fastener head comprises a second diameter, said radial projection comprises a third diameter, said radial projection third diameter greater than said outer diameter of said shank.

10. The fastener in accordance with claim 9 wherein said fastener head second diameter is greater than said outer diameter of said shank.

11. The fastener in accordance with claim 10 wherein said second diameter of said fastener head is hexagonal in shape.

12. The fastener in accordance with claim 10 wherein said fastener head further comprises a top surface comprising a slot configured to receive a screwdriver tip.

13. A method for attaching an antenna system to a vehicle headliner using a mounting system, the antenna system including an antenna module, at least one grounding strap attached to the antenna module, and at least one fastener to attach the grounding strap to the vehicle, the mounting system including a plurality of fasteners including a shank, a fastener head extending from the shank, and a radial projection extending outward from the shank, wherein the antenna system further includes a plurality of coat hooks, an impedance matching module attached to the headliner, a plurality of coaxial cables attached to the headliner, and a power cable attached to the headliner, wherein the fastener shanks have a first diameter, the fastener heads have a second diameter, and the radial projections have a third diameter, the second diameter of the fastener head and the third diameter of the radial projection are greater than the first diameter of the shank, the radial projection configured to engage the grounding strap, the fastener head configured to engage the coat hook, said method comprising the steps of:

attaching the antenna system to the headliner including attaching the antenna module, the impedance matching module, the coaxial cables, and the power cable to the headliner with glue; and attaching the headliner to the vehicle including attaching the headliner to the coat hooks.

14. The method in accordance with claim 13 wherein said step of attaching the headliner to the vehicle further comprises the step of securing the headliner to the vehicle with the fasteners.

15. The method in accordance with claim 14 wherein said step of securing the headliner to the vehicle with the fasteners further comprises the step of extending the fasteners through the coat hooks, the headliner, the grounding strap and into the vehicle such that the antenna system is grounded simultaneously as the coat hooks are secured to the vehicle.

* * * * *